United States Patent [19]

Holowatyj

[11] Patent Number: 4,602,463

[45] Date of Patent: Jul. 29, 1986

[54] TANK CONSTRUCTION HAVING A FLOOR FORMED OF INTERCONNECTED PANELS

[75] Inventor: Stephen Holowatyj, Chicago, Ill.

[73] Assignee: A. O. Smith Harvestore Products, Inc., Arlington Heights, Ill.

[21] Appl. No.: 657,141

[22] Filed: Oct. 3, 1984

[51] Int. Cl.[4] ..... E04H 7/22; E04H 7/30

[52] U.S. Cl. ..... 52/197; 52/247; 220/5 A; 220/75

[58] Field of Search ..... 99/646 R, 646 L, 646 LS; 220/5 A, 75; 52/197, 247, 246, 302, 266

[56] References Cited

U.S. PATENT DOCUMENTS

| | | | |
|---|---|---|---|
| 2,729,313 | 1/1956 | Ernestus | 52/246 |
| 2,827,669 | 3/1958 | Barden | 52/247 |
| 2,852,110 | 9/1958 | Dueringer | 52/247 |
| 3,283,459 | 11/1966 | Beranek | 52/302 |

FOREIGN PATENT DOCUMENTS

| | | | |
|---|---|---|---|
| 733248 | 5/1966 | Canada | 52/197 |

*Primary Examiner*—John E. Murtagh

*Attorney, Agent, or Firm*—Andrus, Sceales, Starke & Sawall

[57] ABSTRACT

A tank construction having a floor formed of interconnected panels. The tank includes a generally cylindrical shell which is supported on a footing and a floor encloses the lower end of the shell. A sump is located centrally of the floor and the floor consists of a plurality of generally pie-shaped panels which extend between the sump to the shell. Bolts connect the inner edge of the panels to the sump, as well as connecting the side edges of the panel together and connecting the outer edges of the panels to a foundation angle which supports the lower end of the shell of the tank. The lower ends of anchor bolts are embedded in the footing and the upper ends of the anchor bolts are located on the outside of the shell and are secured to generally hat-shaped anchor chairs that are mounted on the outer surface of the shell.

10 Claims, 7 Drawing Figures

TANK CONSTRUCTION HAVING A FLOOR FORMED OF INTERCONNECTED PANELS

BACKGROUND OF THE INVENTION

Tanks or silos formed of glass coated steel panels have been used for the storage of materials, such as silage, grain, food products, liquid manure and the like. Tanks of this type consists of a generally cylindrical shell formed of glass coated steel panels bolted together along adjacent overlapping edges. The shell is supported on a cylindrical concrete footing and a concrete floor or foundation encloses the lower end of the shell.

Tanks of this type, having a concrete floor, are not particularly suitable for the storage of liquids, such as water or chemicals. It is difficult to obtain a good liquid-tight seal between the concrete floor and the shell of the tank and the concrete floor may crack causing leakage of the liquid.

As an additional problem, many stored liquids are corrosive and will tend to corrode the concrete floor.

In addition, if the tank is to be constructed in a remote location, it may be difficult to transport the concrete necessary for the floor. Further. if it is desired to relocate the tank to a new location, the concrete floor, being permanent, has to be scrapped and a new floor installed at the new site.

SUMMARY OF THE INVENTION

The invention is directed to a tank construction having a floor formed of interconnected panels and having particular use for the storage of liquid materials. In accordance with the invention, the tank floor includes a sump which is located centrally of the tank, and a plurality of generally pie-shaped, glass coated, steel panels extend between the sump and the cylindrical shell of the tank.

Bolts connect the inner overlapping edges of the panels and the sump, as well as connecting adjacent overlapping edges of the panels together and connecting the outer edges of the panels to a foundation angle which supports the cylindrical shell of the tank.

The tank is secured to the footing through a series of anchor bolts which are connected to anchor chairs mounted on the outer surface of the shell of the tank. Each anchor chair, in combination with the outer surface of the shell, defines an opening to receive the upper end of the respective anchor bolts. The lower ends of the openings have a larger circumferential dimension and a larger radial dimension than the upper ends of the openings, so that the anchor bolts, if somewhat misaligned, can be bent and received within the openings. The upper ends of the anchor bolts extend through washer plates that rest on the top of the anchor chairs and nuts are threaded on the upper ends of the bolts to secure the bolts to the anchor chairs.

The tank construction of the invention, having an integral floor formed of glass coated steel panels, provides a fully sealed structure which is capable of storing liquids without leakage.

By forming the floor panels of glass coated steel, the panels are corrosion resistant, so that the tank can store acidic or alkaline materials.

The tank can be readily assembled in the field and disassembled and moved to another site, if desired.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

The drawings illustrate a tank having particular use in storing liquid materials such as water or chemicals. The tank includes a generally cylindrical shell 1 which is supported on a footing 2 and the lower end of shell 1 is enclosed by a floor 3.

The upper end of the shell can either be open or enclosed by a roof, if desired. The shell 1 can be composed of a series of curved, glass coated steel panels or sections, which are bolted together along adjacent overlapping edges, as disclosed in U.S. Pat. No. 2,729,313.

Figure 7:
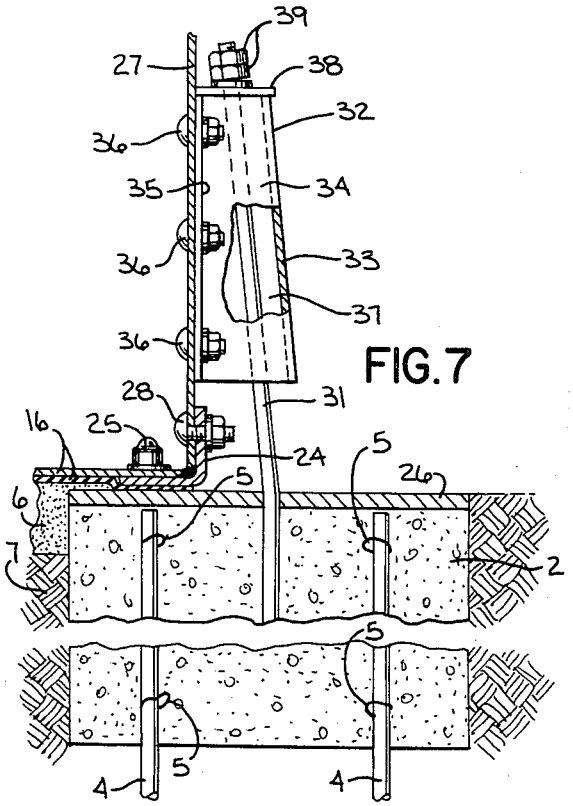
FIG. 7 is a section taken along line 7—7 of FIG. 6.

As best illustrated in FIG. 7, the concrete footing 2 includes two rows of vertical reinforcing rods 4 which support circumferential reinforcements 5. Extending within footing 2 beneath floor 3 is a layer of gravel and oiled sand 6 which is supported on the undisturbed earth 7.

In accordance with the invention, floor 3 includes a sump 8 which is located centrally of the tank and the lower portion of sump 8 is formed with an outlet 9 that is connected to a drain line 10. Drain line 10 extends within the gravel layer 6 to the exterior of the tank.

Sump 8 is set in position by a series of anchor rods 11 which are connected to brackets 12 mounted on the outer surface of sump 8. A suitable perforated cover 13 can be positioned in the upper end of the sump. If a drain line 10 is not connected to sump 8, the sump can be filled with sand prior to installing cover 13.

Figure 1:
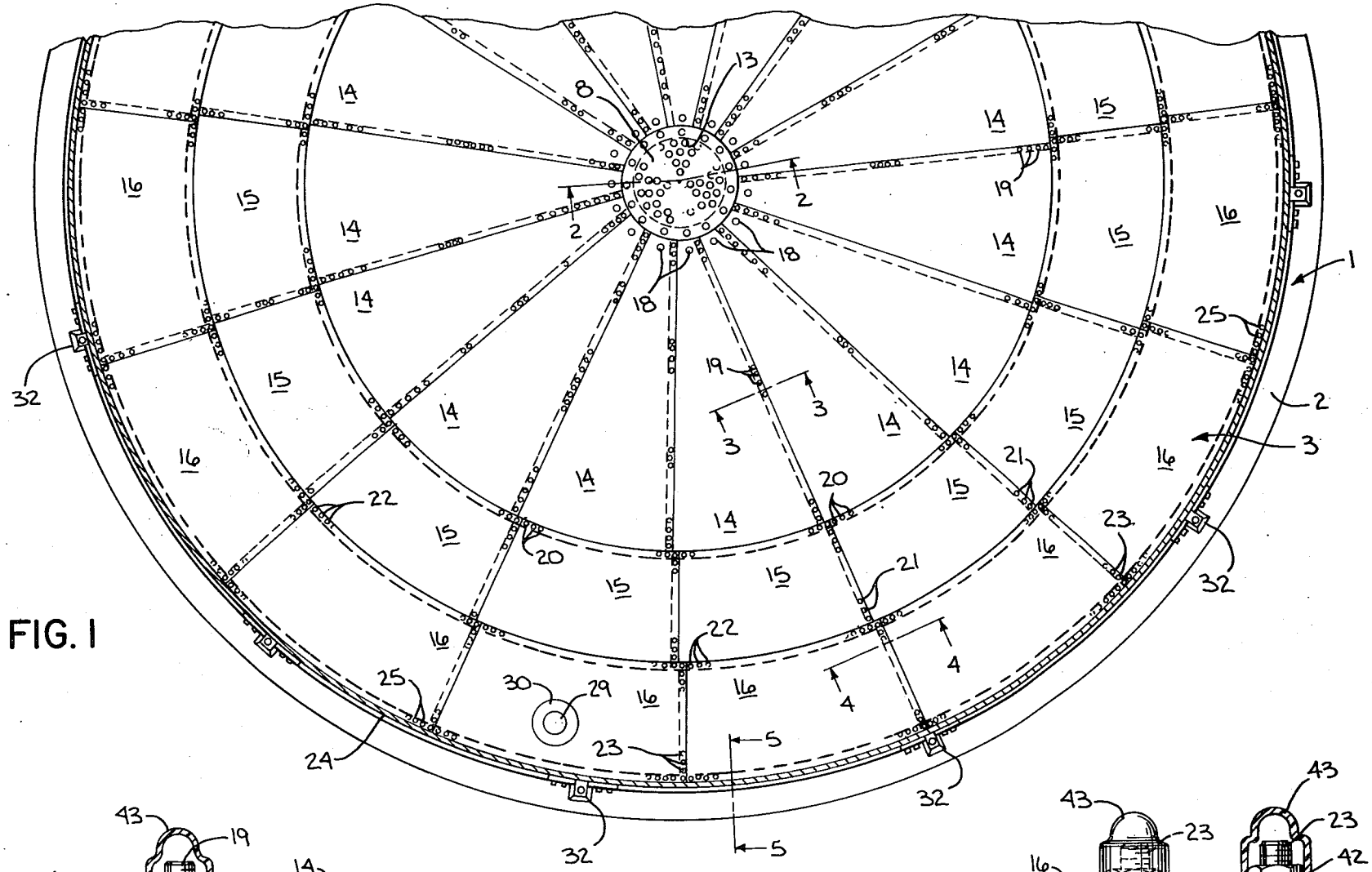
FIG. 1 is a fragmentary plan view of the floor of the tank of the invention.
Figure 4:
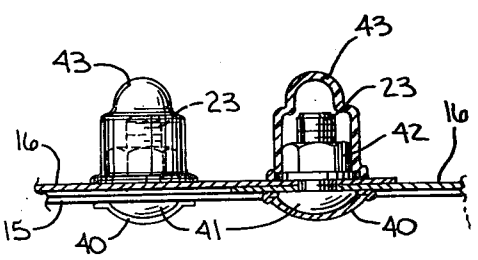
FIG. 4 is a section taken along line 4—4 of FIG. 1.
Figure 3:
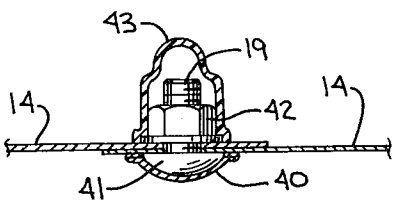
FIG. 3 is a section taken along line 3—3 of FIG. 1.

Floor 3 also includes a plurality of panels or sections, preferably formed of glass coated steel, which extend radially between sump 8 and cylindrical shell 1. As best shown in FIG. 1, the floor includes a plurality of generally pie-shaped, inner panels 14, a plurality of intermediate panels 15 and a plurality of outer panels 16. With smaller diameter tanks, the floor 3 may consist only of the panels 14, while intermediate diameter tanks will include panels 14 and 15 and larger diameter tanks will include the three series of panels 14, 15 and 16.

Figure 2:
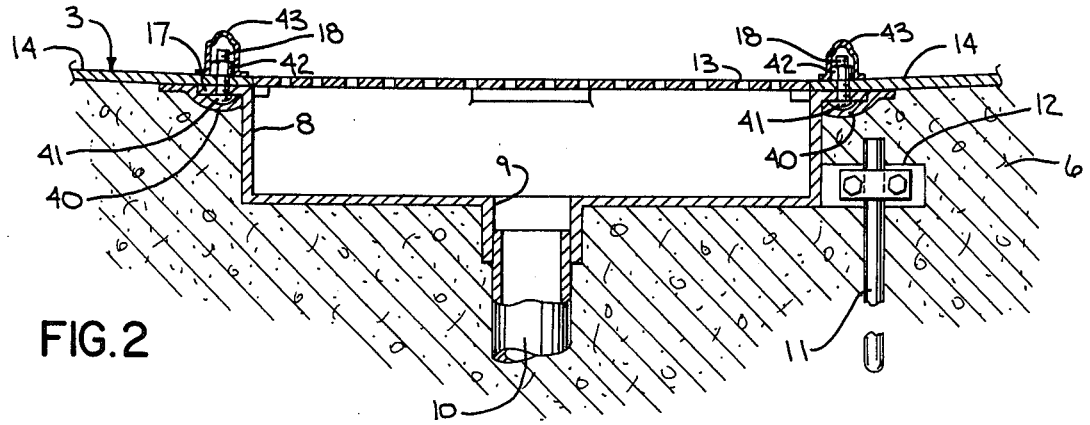
FIG. 2 is a fragmentary vertical section showing the central sump.

As best illustrated in FIG. 2, the inner ends of panels 14 overlap the circumferential flange 17 on sump 8 and are connected to the flange through a series of bolts 18. The overlapping side edges of adjacent panels 14 are connected together by bolts 19, while the outer ends of panels 14 are connected to the overlapping inner ends of panels 15 by bolts 20. Similarly, the side edges of panel 15 are connected together by bolts 21 and the outer ends of panels 15 are connected to the overlapping inner ends of panel 16 through bolts 22. The side edges of panel 16 are connected together by bolts 23, as shown in FIG. 1.

Figure 5:
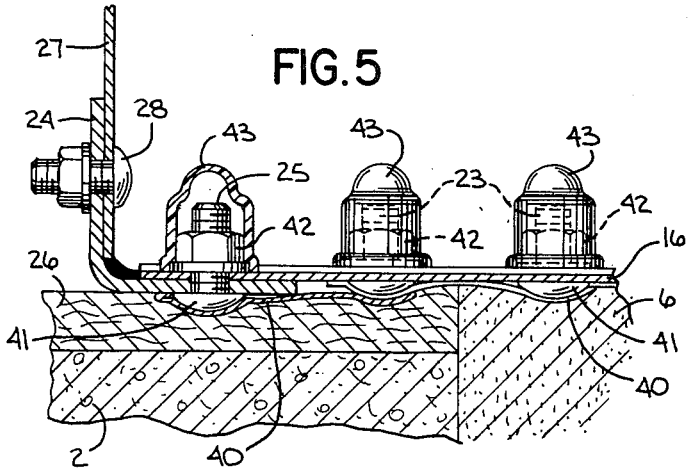
FIG. 5 is a section taken along line 5—5 of FIG. 1.

As illustrated in FIG. 5, the outer edges of the outer panels 16 are connected in overlapping relation to the horizontal leg of a foundation angle 24 through bolts 25.

As shown in FIG. 5, bolts 25, as well as the outer bolts in the row of bolts 23 are located above the footing 2. A layer 26 of compressive material, such as cane fiber, is positioned on the upper surface of footing 2 and the heads of the bolts will be embedded within the layer of compressive material, as illustrated in FIG. 5.

The vertical flange of foundation angle 24 is connected through the lowermost or starter ring 27 of shell 1 by bolts 28.

Figure 6:
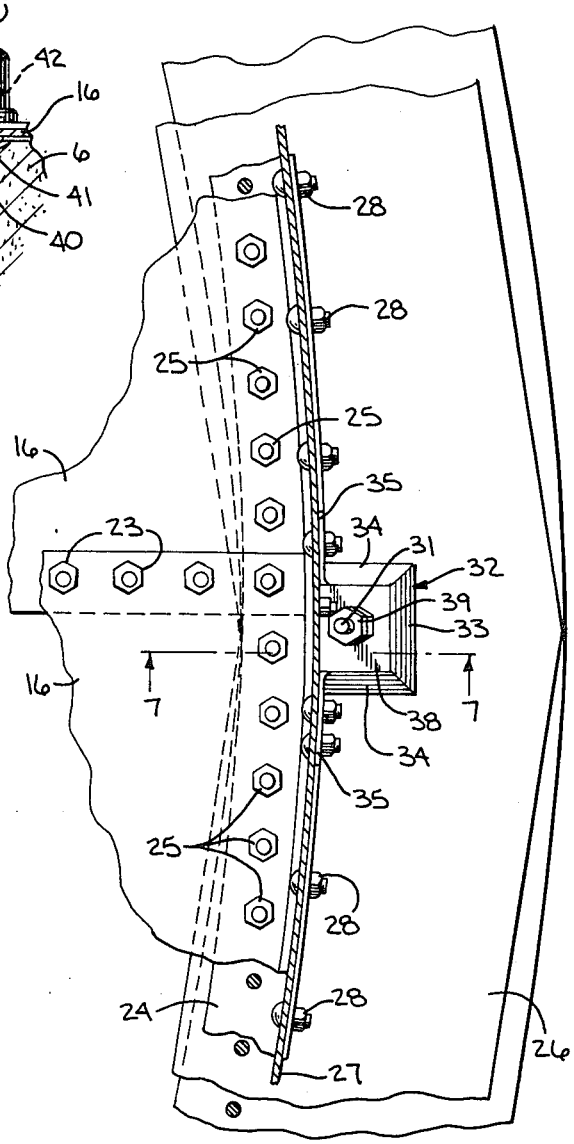
FIG. 6 is a fragmentary enlarged plan view.

Liquid can be introduced to the tank through an inlet pipe 29 which is threaded in a connector 30 secured within an opening in one of the outer panels 16. Inlet pipe 29 extends within the gravel layer 6 to the exterior of the tank. Depending on the usage of the tank and the material stored, pipe 29 can, in some installations, function as an outlet To secure the the tank to the footing 2, a series of anchor bolts 31 are embedded in the footing and the upper end of anchor bolts 31 are secured to anchor chairs 32 mounted on the exterior surface of starter ring 27. Each anchor chair 32, as best illustrated in FIGS. 6 and 7, includes an outer surface 33 which slopes downwardly and outwardly away from starter ring 27, and a pair of downwardly diverging sides 34 which terminate in flanges 35 that are attached to starter ring 27 through bolts 36. Anchor chair 32, in combination with the starter ring 27, define openings 37 which receive anchor bolts 31. Due to the sloping surface 33 and sloping side 34, the bottom end of each opening 37 has a larger circumferential dimension, as well as a larger radial dimension, than the upper end. This configuration enables the projecting upper ends of anchor bolts 31, if not properly aligned with anchor chairs 32, to be bent and more readily received within the openings in the anchor chairs.

To secure the bolts 31 to the anchor chairs 32, a plate or washer 38 rests across the top of the chair, and the upper end of the bolt extends through an opening in washer 28 and receives nuts 39.

To construct the tank, the concrete footing 2 is initially poured with reinforcements 4 and 5 as, well as anchor bolts 31 set therein. Sump 8 is then properly set in gravel layer 6 through anchor rods 11 and drain line 10 is connected to the sump. Prior to setting the sump, bolts 18 are inserted from beneath through the holes in the flange 17 of the sump. To hold the the bolts in position, pressure sensitive tape 40, such as duct tape, is applied over the bolt heads 41 and secured to the under surface of flange 17, as shown in FIG. 2. The inner edge of an inner panel 14 is then positioned in overlapping relation with flange 17 on sump 8 with the bolts 18 extending through holes in the edge of the panel. Nuts 42 are then threaded onto the projecting ends of the bolts 18 and plastic corrosion resistant bolt head covers 43 are then press fitted over the nuts, as illustrated in FIG. 2.

Prior to assembling the first panel 14 to sump 18, a row of bolts 19 are inserted from beneath through holes along one side edge of the panel and bolts 20 are inserted through holes along its outer edge. Both rows of bolts 19 and 20 are held in place against the under surface of the panel 40 by the pressure sensitive tape 40. A second panel 14 having a row of bolts 19 along one side edge and a row of bolts 20 along its outer edge and held in place through tape 40 is then slipped under the edge of the first panel 14 so that the bolts 19 on the second panel will be inserted through the holes in the side edge of the first panel and the holes in the inner edge of the second panel will receive the bolts 18 on the sump flange 17. Nuts 42 and nut covers 43 are then applied to the bolts along the overlapping edges of the panel 14, as well as to the bolts 18 connecting the inner edge of the second panel 14 to the sump.

This procedure is repeated until all of the panels 14 have been connected to the sump 8.

To attach the second tier of panels 15 to the assembled panels 14, one of the panels 15 with preassembled bolts 21 and 22 along one side side edge and holes along the outer edge respectively and held in place by tape 40, is then assembled with one of the inner panels 14, with the holes along the inner edge of the panel 15 receiving the projecting bolts 20 from the inner panel 14.

A second intermediate panel 15, having bolts applied to one side edge and along its outer edge, is then attached to the respective outer edge of panel 14 and side edge of the first intermediate panel 15 in the manner described and this procedure is repeated until the entire group of intermediate panels 15 has been assembled.

The same procedure is then used to attach the outer panels 16 to the intermediate panels 15.

Following the installation of the outer panels 16, the foundation angle is connected to the outer edges of panels 16, and the starter ring 17 is connected to the foundation angle through bolts 28.

The bolts 18–23 and 25 are all of similar construction and the nuts 42 which are located inwardly of the tank are all enclosed by corrosion resistant nut covers 43.

To seal the overlapping edges of panels 14–16, as well as to the joint between the panels 16 and foundation angle 24, a suitable mastic or sealant is applied to the overlapping surfaces of the members.

The anchor chairs 32 are then positioned around the upper ends of the anchor bolts 31 and are mounted to the starter ring through bolts 36. If the anchor bolts are misaligned, they can be bent to the proper position and the configuration of the openings 37 in the anchor chairs 32 permits the bent anchor bolts to be received within the openings. Washers 38 and nuts 39 are then assembled to secure the anchor bolts 31 to the anchor chairs 32.

The anchor bolts 31 enable the empty tank to withstand high wind pressures, particularly if the tank has a substantial height.

Following the assembly of the floor, the rows of glass coated panels forming the shell 1 can be mounted to the starter ring by a jacking system, similar to that described in U.S. Pat. No. 2,794,242. The jacks are normally located on the inside of the starter ring 17 and can be supported from angle clips that are mounted to the foundation angle, so that the lower ends of the jacks are not directly supported on the glass coated panels of the floor. A central erecting jack can be mounted in sump 8.

The tank of the invention includes an integral floor which is totally sealed and thus is particulary adapted for storage of liquid materials. As the panels are preferably formed of glass coated steel, they are corrosion resistant, so that the tank can be used for the storage of corrosive materials.

If it is desired to relocate the tank, the shell and floor can both be readily disassembled and moved to the new site.

Various modes of carrying out the invention are contemplated as being within the scope of the following claims particulary pointing out and distinctly claiming the subject matter which is regarded as the invention.

I claim:

1. A tank construction, comprising a footing, a cylindrical shell supported on the footing, and anchor means for securing the shell to said footing, said anchor means comprising a plurality of anchor bolts embedded in said footing with the upper end portions of said bolts disposed radially outward of said shell, a plurality of anchor chairs secured to the outer surface of the shell, each anchor chair having a generally vertical opening to receive one of said anchor bolts, the bottom of each opening having a larger cross sectional area than the top of said opening, each bolt extending through the respective opening with the upper end of said bolt projecting above said anchor chair, and means connected to the upper projecting end of each bolt for securing each bolt to the top of the respective anchor chair, the cross sectional area of said top being substantially greater than the cross sectional area of the bolt whereby a misaligned bolt can be bent and passed through the opening in said anchor chair.

2. The tank construction of claim 1 wherein each of said anchor chairs includes an outer surface spaced from the exterior surface of said shell and a pair of side surfaces connecting said outer surface to said shell, said outer surface, said sides and said shell defining the opening.

3. The tank construction of claim 2, and including a plate disposed across the top of each anchor chair, said plate having an opening to receive the upper end of the respective anchor bolt, and a nut threaded on the upper end of the anchor bolt and bearing against said plate.

4. A tank construction, comprising a footing, a generally cylindrical shell supported on the footing, a floor enclosing the lower end of the shell, said floor including a plurality of panels, said panels having overlapping adjacent edges, the outer ends of the panels being connected to the shell, a foundation member having a horizontal leg connected to the outer ends of the panels and having a vertical leg connected to the shell, anchor means for securing the shell to said footing, a plurality of bolts interconnecting said overlapping side edges, and a strip of pressure sensitive tape covering the lower ends of said bolts and securing the bolts to the bottom surface of one of said pair of panels.

5. The tank construction of claim 4, wherein a group of said bolts is disposed above said footing, and said tank construction includes a layer of compressive material disposed on the upper surface of said footing, the lower ends of said group of bolts being embedded in said compressive mateiral.

6. The tank construction of claim 4, and including a plurality of second bolts connecting the outer end of each panel to said foundation member.

7. A tank construction, comprising a generally circular footing, a generally cylindrical shell supported on the footing, a foundation disposed within said circular footing, a floor enclosing the lower end of said shell and resting on said foundation, said floor including a central panel disposed at the center of said shell, said floor also including a first group of panels, each first panel having curved inner and outer edges and each first panel having outwardly diverging side edges, the inner edge of each first panel being disposed in lapping relation to said central panel, a plurality of first bolts disposed in aligned holes in said central panel and said inner edges, the side edges of each first panel being disposed in lapping relation with side edges of adjacent first panels, a plurality of second bolts disposed in aligned second holes in said lapping side edges, pressure sensitive tape means for securing the lower ends of said first and second bolts to the undersurface of the respective panels, and means for interconnecting the outer edges of said first panels to said shell.

8. The tank construction of claim 7, wherein each of said first and second bolts includes a head disposed beneath the respective panels, a stem extending through the respective aligned holes, and a nut threaded on the upper end of said stem and disposed on the outer surface of the respective panels.

9. The tank construction of claim 8, and including a corrosion resistant cover enclosing each nut and the upper end of the corresponding stem.

10. The tank construction of claim 7, wherein said panels include a steel base and a fused glass coating disposed on opposite surfaces of said base.

* * * * *